US006233876B1

(12) United States Patent
Obidniak

(10) Patent No.: US 6,233,876 B1
(45) Date of Patent: May 22, 2001

(54) PIVOTABLE GUTTER ASSEMBLY AND KIT THEREFOR

(76) Inventor: Louis Obidniak, 3115 Ramesay, Laval, Quebec (CA), H7E 2J6

( * ) Notice: Subject to any disclaimer, the term of this patent is extended or adjusted under 35 U.S.C. 154(b) by 0 days.

(21) Appl. No.: 09/342,075

(22) Filed: Jun. 28, 1999

(30) Foreign Application Priority Data

Jun. 29, 1998 (CA) ..... 2239894

(51) Int. Cl.[7] ..... E04D 13/064; E04D 13/072; E04D 13/08

(52) U.S. Cl. ..... 52/16; 52/11; 248/48.2

(58) Field of Search ..... 52/11, 16; 248/48.1, 248/48.2

(56) References Cited

U.S. PATENT DOCUMENTS

| | | | | |
|---|---|---|---|---|
| 1,141,204 | | 1/1915 | Noce . | |
| 2,631,801 | | 3/1953 | Toal . | |
| 3,616,582 | | 11/1971 | Walek et al. . | |
| 4,019,290 | | 4/1977 | Manty . | |
| 4,072,285 | * | 2/1978 | Greenwood | 248/48.2 |
| 4,185,420 | | 1/1980 | Medland . | |
| 4,446,658 | | 5/1984 | Gouin . | |
| 4,709,516 | * | 12/1987 | Gleaves | 52/11 |
| 4,745,657 | * | 5/1988 | Faye | 52/11 X |
| 4,807,406 | * | 2/1989 | Densmore | 52/11 |
| 4,813,190 | | 3/1989 | Wittig . | |
| 4,837,987 | * | 6/1989 | Fender | 52/11 |
| 5,146,718 | * | 9/1992 | Baskett | 52/11 |
| 5,184,435 | * | 2/1993 | Sherman | 52/11 X |
| 5,274,965 | * | 1/1994 | Jackson | 52/11 |
| 5,317,843 | * | 6/1994 | Sheehan | 52/11 |
| 5,335,460 | * | 8/1994 | Smith, Jr. | 52/11 |
| 5,357,719 | * | 10/1994 | Lewis | 52/11 |
| 5,417,015 | * | 5/1995 | Coyne | 52/11 |
| 5,649,681 | * | 7/1997 | Faye | 248/48.1 |

FOREIGN PATENT DOCUMENTS

| | | | | |
|---|---|---|---|---|
| 646599 | * | 4/1993 | (AU) | 52/11 |

* cited by examiner

*Primary Examiner*—Laura A. Callo
(74) *Attorney, Agent, or Firm*—Marshall & Gould P.C.

(57) ABSTRACT

A pivoting gutter assembly is disclosed, in which the gutter can be, during summer months, put into the horizontal collecting position to receive rainwater from the roof and to direct it to a down-spout. For the winter months and or maintenance, the gutters are swung-out to downwards vertical position below the roof cornice thus being protected from damage. The gutter system includes hangers attached to the roof, the hangers each having a bearing. A shaft is inserted into the bearing and the gutter is fixed to the shaft. The system provides for special hangers assuring the correct pitch of the gutters. Also, it contains a down-spout for location above a fixed downward collector for rainwater, thus permitting the gutters to be pivoted from horizontal to vertical position without the need to disconnect the down-spout. A wormgear and wormdrive are attached to the end of shaft, outside the house fascia; this drive permits to operate the gutter's position from the ground level by an extended bar and manually driven crank or by using electric motor's drive attached to worm and remote control, eliminating the need of a ladder to reach downward position particularly important for the gutters installed on the roof high above the ground such as high rise buildings.

7 Claims, 10 Drawing Sheets

PIVOTABLE GUTTER ASSEMBLY AND KIT THEREFOR

FIELD OF THE INVENTION

The present invention relates to a pivotable gutter assembly and a kit for the same. The gutter assembly is pivoted to a horizontal position to receive the rainwater falling from the roof and direct the rainwater to down-spout to evacuate it away from the house. The pivotable gutter assembly can be pivoted to a vertical position in order to permit cleaning thereof, or to hide the gutter assembly under the roof's cornice in the winter months.

DESCRIPTION OF THE PRIOR ART

It is estimated that on average, 5000 gallons of rainwater fall on the roof of a typical house in Canada, during a year. To collect this rainwater from the roof, a system of gutters and down-spouts are installed, and permanently affixed to the roof cornice's fascia plate, and to the house. It should be understood at the outset that the word "house" is intended to include any structure having a roof and which requires a gutter system to evacuate the water therefrom. Likewise, the expression "homeowner" is meant to include any person in charge of maintenance of a house or any like structure.

Presently, the gutters are nailed to the fascia, as shown in FIG. 3, labelled "Prior Art", where a sleeve maintains the width of the gutter. The nail perforates the fascia and the resulting hole promotes water seepage along the nail's hook, when the gutter is full of water, particularly during the winter thaw.

FIG. 4 shows various cross-sections of fascias and cornices in today's houses. It can be clearly appreciated that the fascia element is the appropriate element to fasten any type of gutter assembly, as is presently done.

However, all gutters and down-spouts should be inspected and cleaned periodically by homeowners. Leaky, damaged and partially clogged gutters give unsatisfactory services, and can also be a direct cause of other more serious troubles, such as water getting in the attic or seeping into the walls near the cornices. For this reason, regular servicing of the gutters is required.

Difficulty may arise from the accumulation of leaves, rubbish and bird's nests in gutters. Such debris, if not promptly removed, may clog the opening to the down-spout and cause the water to back-up and flow over the edge of the gutter. Accordingly, the gutter, as well as the down-spout must be periodically cleaned.

One solution has been to propose leaf guards or strainers, installed along the gutter or over the down-spout. Even if leaf guards or strainers have been installed at the down-spout opening, an accumulation of wet leaves will prevent proper drainage and may cause water to overflow and seep into walls of the house. It is thus essential to remove the debris from gutters as soon as possible after they collect, and flush the gutter system with a hose.

If the gutters are not fitted with leaf strainers, leaves may accumulate in the gutter system and completely close the passage to water. In cold weather, water may accumulate and freeze in clogged down-spouts. These conditions, as mentioned above, may be avoided if the homeowner will remember to clean out the gutters regularly, especially in autumn, after the leaves have fallen. It is also important and advisable to remove heavy snow and ice from gutters to permit proper roof drainage and prevent damage to the gutters by the excessive weight of such masses. The accumulated snow and ice in the gutter will prevent, during the spring thaw, the roof run-off from being properly drained, and water may seep into the roof and wall of the house, causing considerable and expensive damage to the roofs and wall structures near the cornice. Also, water may collect and freeze in clogged elbows and down-spouts, causing considerable damage to these parts due to the expansion of the water when it freezes.

For these reasons, regular servicing of the gutter system is a sure way of reducing time-consuming upkeep and costly repairs.

However, it is not easy to clean the presently installed gutters. The homeowners must climb the ladder, or go on the roof to clean the gutters and down-spouts. In some cases, even an auger must be used to clean obstructions in such drains or down-spouts. These cleaning procedures are not only difficult but can also be dangerous, and often homeowners will call upon professionals to clean the gutters, which can be costly.

Gutters which are not regularly cleaned will deteriorate and will require replacements, and also will cause damage to the fascia and to the cornices and wall of the house.

In the prior art, there are many devices disclosed to attempt to resolve this problem. Reference can be made, for example, to U.S. Pat. Nos. 1,141,204; 2,631,801; 3,616,582; 4,019,290, 4,185,420; 4,446,658 and 4,813,190. However, those devices do not disclose a mechanical construction which can adequately and completely empty the gutter. These devices also describe an intricate mechanism in response to the accumulated overflow of snow, ice or debris and to partially empty the gutter. The disclosed mechanisms are exposed to weather elements and would become inoperative should ice accumulate in or on the moving parts.

A significant absence in the prior art is the lack of any description regarding the gutter pitch, i.e. the slope of the gutter which permits water to drain downwardly, and also how those gutters are disconnected from the down-spout when the gutter is pivoted from the horizontal to the vertical position.

Most of the above-mentioned prior art devices require, to move the gutter from one position to another, a step ladder to reach the moving mechanism, which can be a complicated and dangerous operation, particularly when the gutters are at a substantial distance above ground level, as is the case with highrise buildings.

SUMMARY OF THE INVENTION

It is an object of the present invention to provide a pivotable gutter system and a kit therefor, which facilitates maintenance and cleaning of the gutter assembly. The gutter system can be swung out from the horizontal, or summer position, to a vertical, or winter position, below the cornice, facilitating the removal of accumulated debris, by simply rinsing the gutters from the ground level, using a nozzle at full water pressure.

In accordance with the invention, this object is achieved with a pivotable gutter system for a roof, having a fascia. The system comprises:

- a plurality of hangers having a top and a bottom, the top being fastened to the fascia, the bottom including a bearing having a rotational axis, said hangers spanning a length of said fascia and being spaced from each other by a predetermined distance;
- a shaft rotatably mounted in said bearings of said hangers, said shaft having a rotational axis coincident with the rotational axis of the bearings;

a gutter mounted along said shaft, said gutter being provided with at least one down-spout; and means to pivot said shaft.

The gutter assembly is pivoted between an operative position, where the gutter is adjacent and below the roof in order to collect rainwater and direct it to the down-spout for evacuation, to an inoperative position, where the gutter is at least at a 90° angle with respect to the operative position, in order to permit easy cleaning of the gutter with a stream of water. This position can also be used to "hide" the gutter under the roof during the winter months so that there is no accumulation of water (and ice) or other debris therein, which would otherwise damage the gutter, or cause damage to the roof or to the walls of the house.

Preferably, the hangers have a fixed length and lowered by a distance between L and L+X, so that the hangers are installed from one end of the fascia to the other end of the fascia with a gradually increasing (or decreasing) distance from fascia, as the case may be, as long as the down-spout of the gutter is located adjacent the lowest gutter position (having a length L+X). This gradual increase in hanger position gives the shaft, and therefor the gutter, a downward pitch, permitting easier evacuation of the water. Preferably, the hangers are sold as a set with a predetermined length, so that the homeowner can easily install the hangers by following indicia printed thereon and lower the hanger from position L (X=0 ) to L+X.

It should also be understood that the down-spout does not need to be located at one or the other end of the fascia, but could be located at a point in between.

In a preferred embodiment, the down-spout is located above a fixed downward collector, but not in engagement therewith. Consequently, the fixed downward collector does not interfere with the pivoting of the gutter assembly.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

Figure 1:
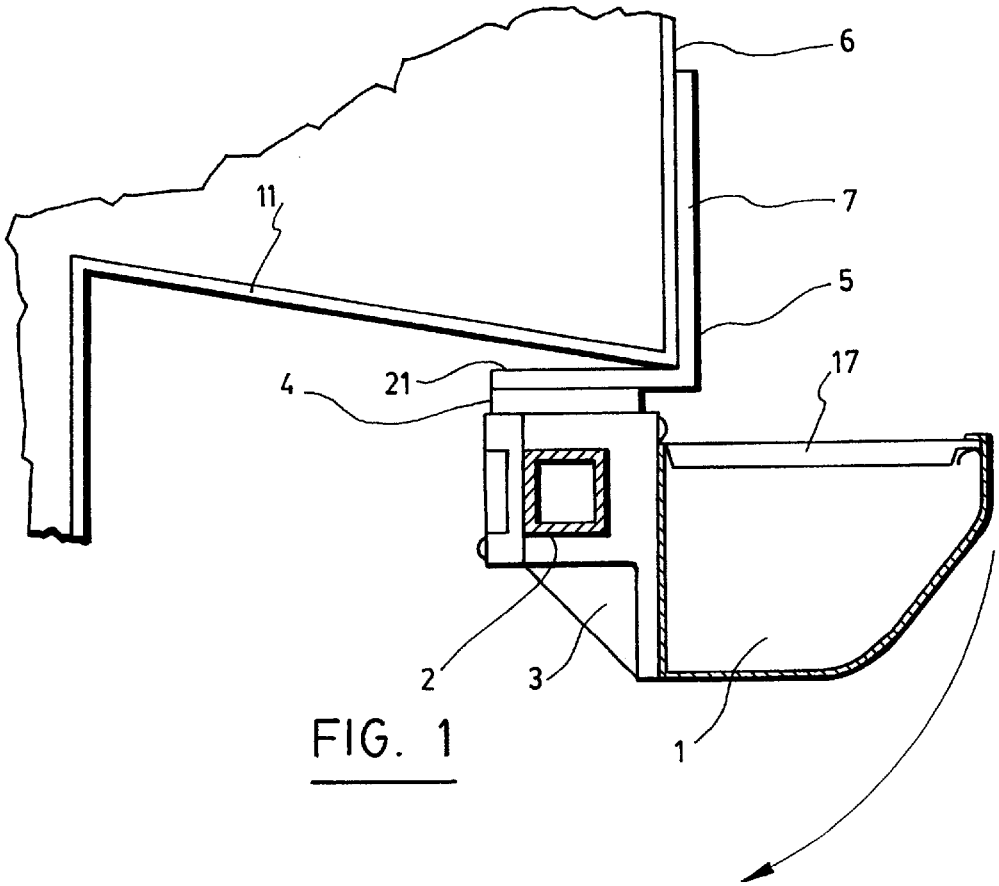
FIG. 1 represents a cross-section view of the gutter system according to a preferred embodiment of the invention in operative position and details of bracket assembly with the shaft and gutter.

The pivotable gutter system according to the invention comprises as its main elements a plurality of hangers 5, each having a bearing 4, a shaft 2 rotatably mounted in the bearings 4, a gutter 1 mounted on the shaft 2 and means to pivot the shaft 2.

Referring now to FIG. 1, the shaft 2, which is preferably square, is mounted in the bearings 4 of the hangers 5. As can be seen, the hangers have a vertical leg 7 which is fastened to the fascia of the roof, for reasons which will be explained hereinafter, and a bottom 21, in the shape of a horizontal leg. The gutter 1 is attached to the shaft 2 through a bracket 3 mounted on the shaft 2 at regular intervals. The bracket also includes a holding bracket 17 which is wrapped around the gutter and which is attached to the bracket 3 (see FIG. 8A and FIG. 8B). The brackets are movable along the square shafts for proper positioning during assembly and then tightened by a screw to lock it in position. The brackets 3 are usually disposed every 3 to 4 ft (approximately 1 m) of the gutter's length.

Figure 4:
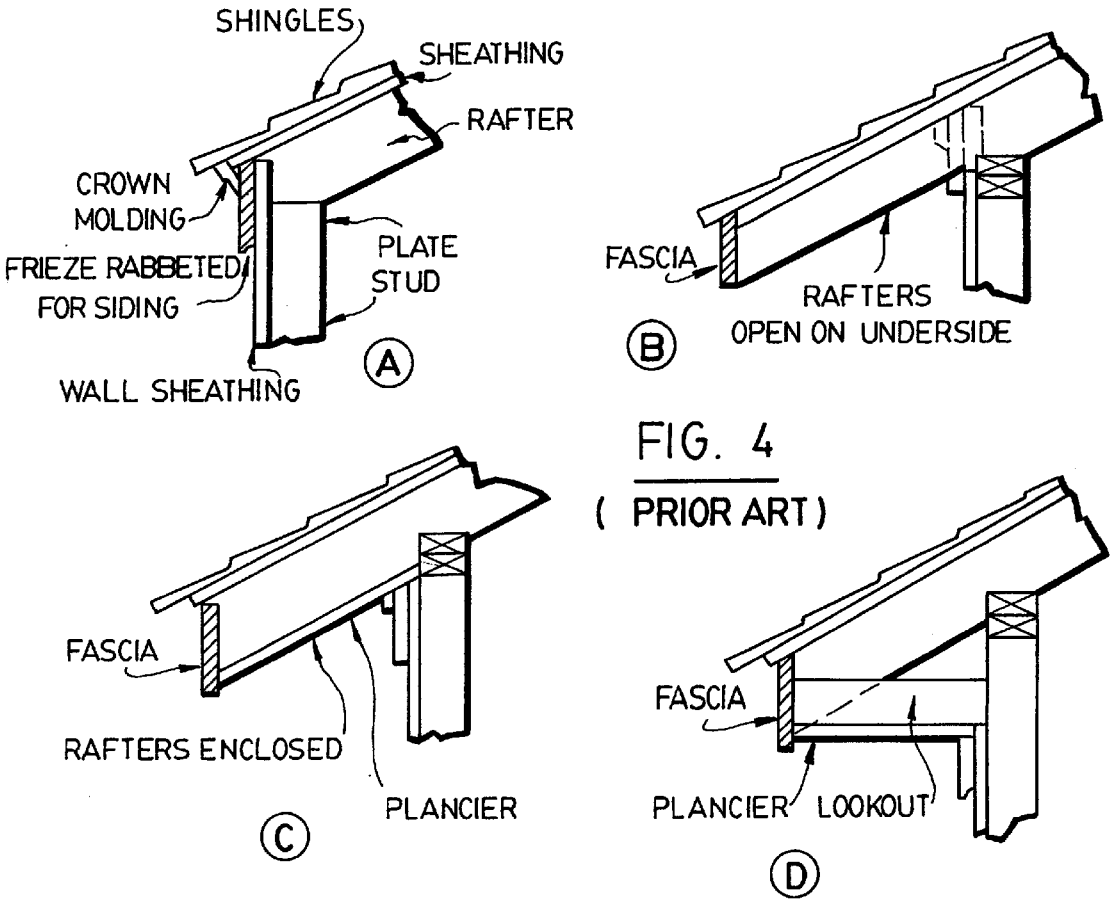
FIG. 4 ( PRIOR ART )
FIG. 4, labelled "Prior Art" represents fascia and cornice details of present house construction.

Referring now for FIG. 4, where eave overhang is wide, the extending rafters sometimes are left uncovered on the underside (FIG. 4B) or in recent years, the rafters are enclosed and covered by wooden boards. In wide box cornices, the rafters are covered by a horizontal wooden cover (FIG. 4D) called "plancies" which encloses the cornice from below.

As it can be appreciated, there is a great number of cornice constructions, but all of the rafters are enclosed from the front with a sturdy vertical board nailed vertically to the rafters, called "fascia" and this cornice element is common to all roofs, and all present gutters are attached to this element. This fascia element has been elected by this invention to be a construction element which exists on almost all houses and to which gutters hanger are easily attached without any changes to the house structure. Accordingly, houses which are not provided with a fascia will not be able to benefit from the invention.

Figure 6A:
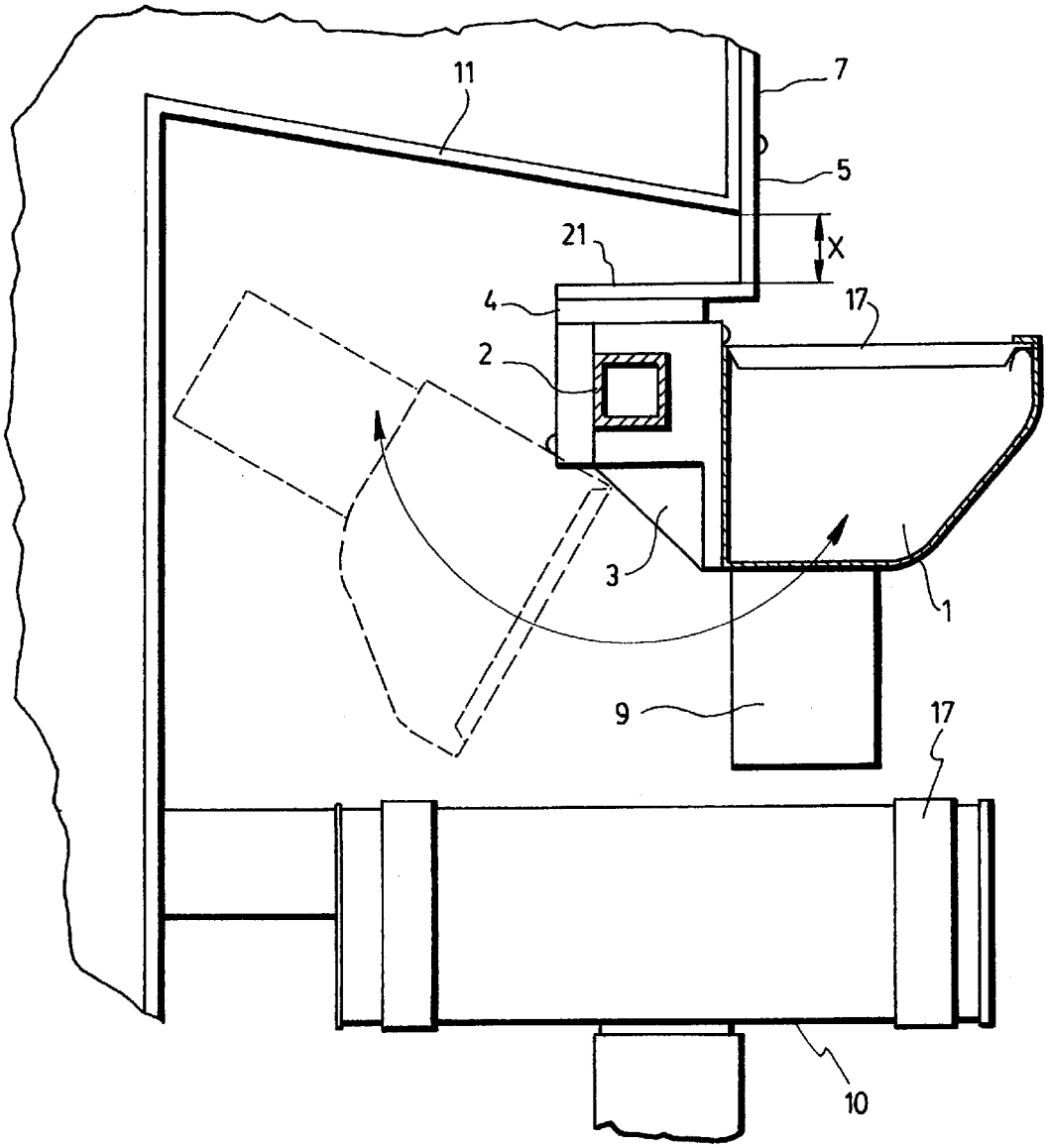
FIG. 6A represents the cross-section of the gutter outlet.
Figure 6B:
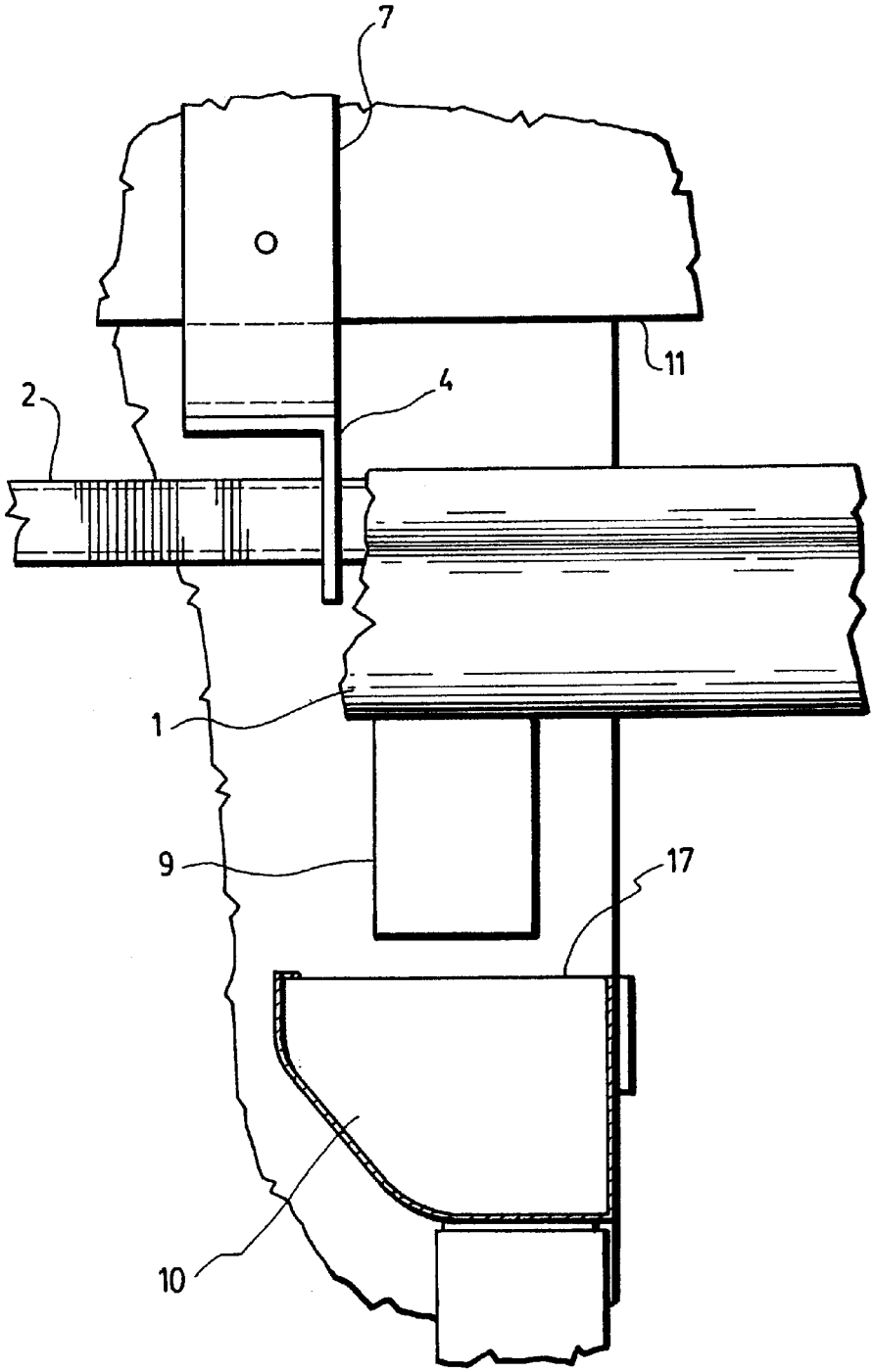
FIG. 6B represents the front elevation of the gutter's downspout which rotates with it above a fixed collector.
Figure 7A:
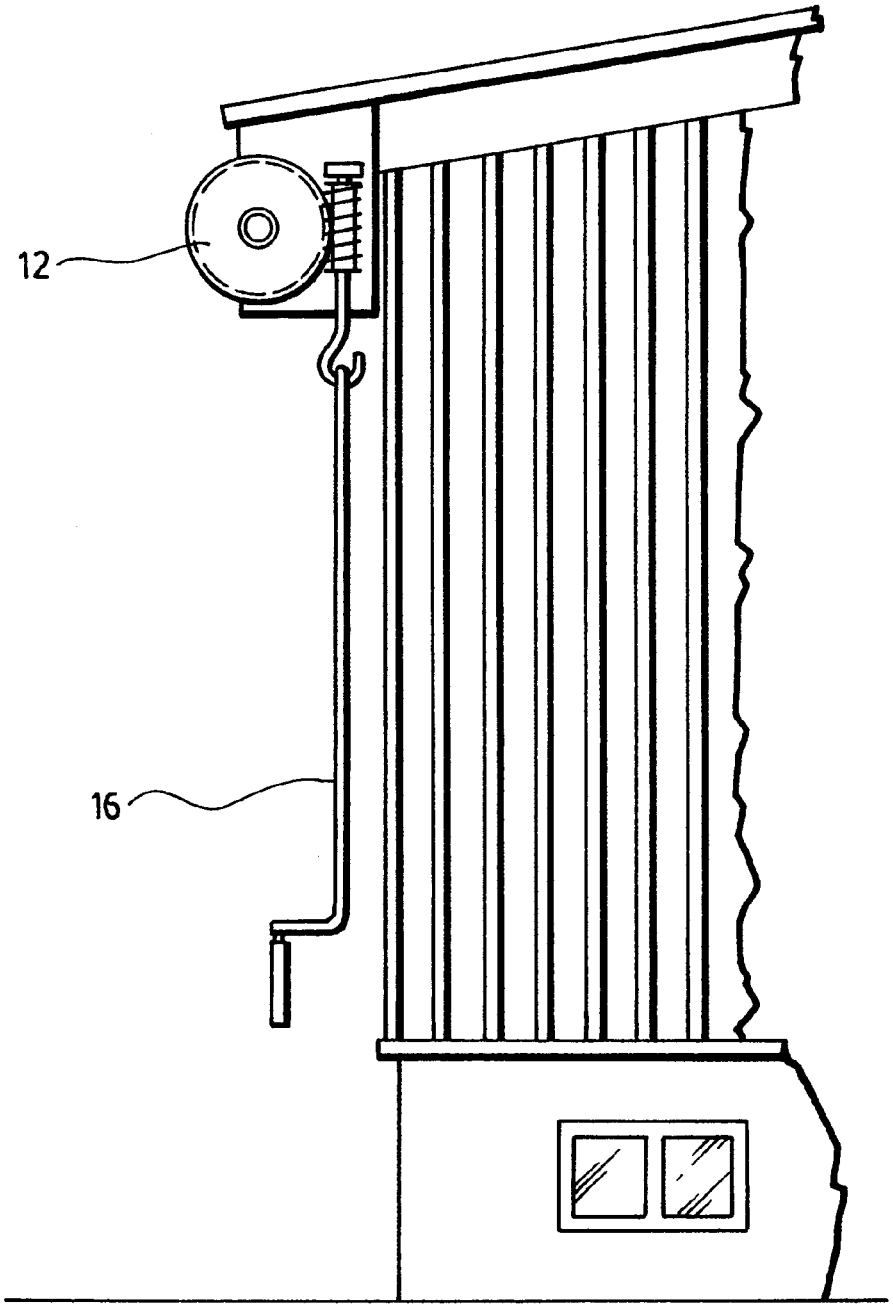
FIG. 7A represents the side elevation at reduced scale, showing one gear drive and crank operated from ground level.
Figure 7B:
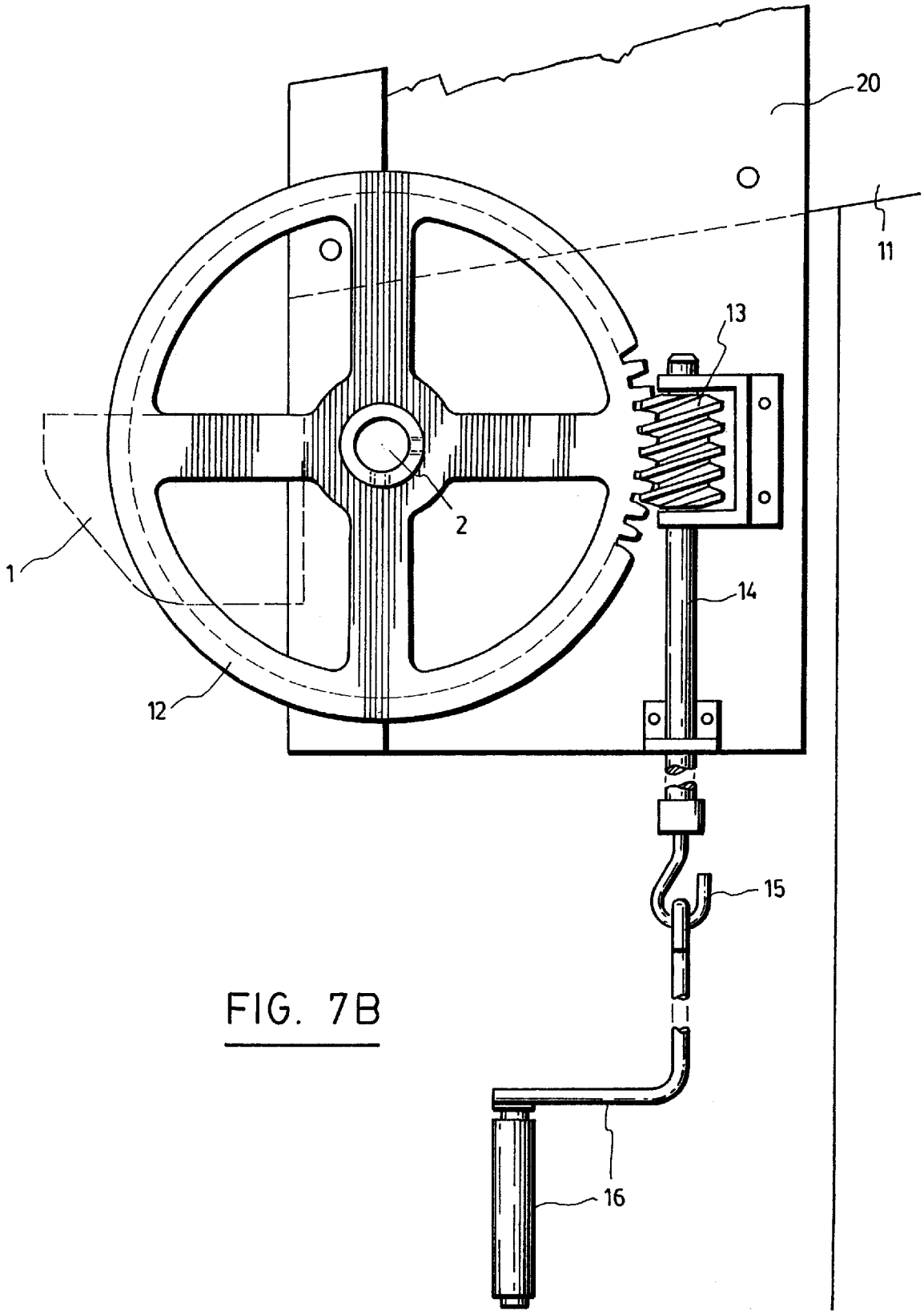
FIG. 7B represents the wormgear drive to pivot the gutter from summer to winter position and its hand operated crank to drive the worm gear.

FIG. 1 shows the gutter 1 in operative position to collect the rainwater and direct it to the downward collector 10 (see FIGS. 6A and 6B).

Figure 2:
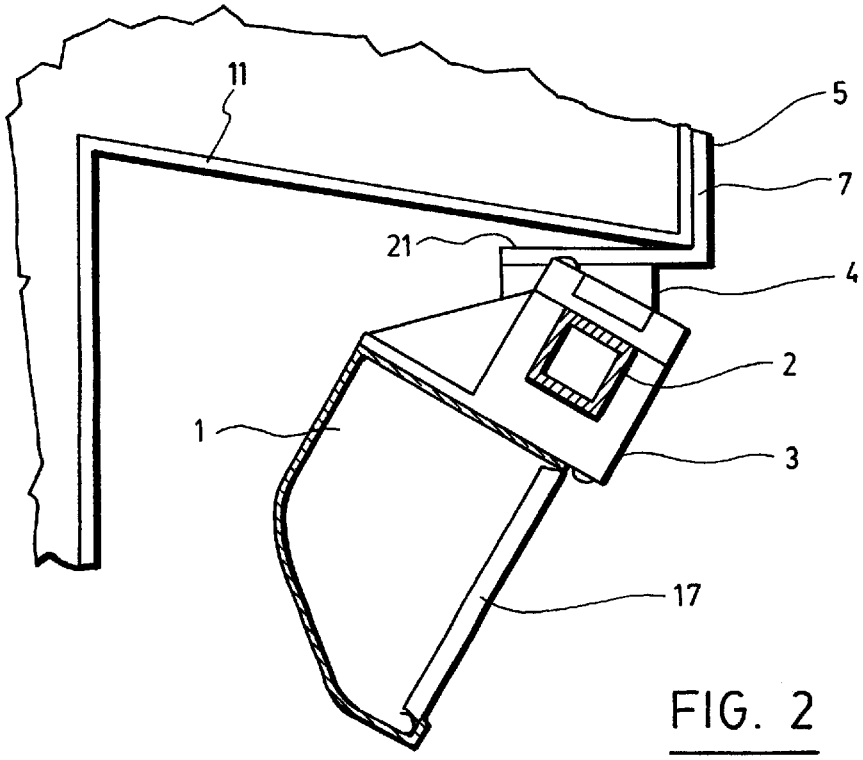
FIG. 2 represents the gutter system of FIG. 1 in inoperative position for cleaning, maintenance an for winter months.
Figure 3:
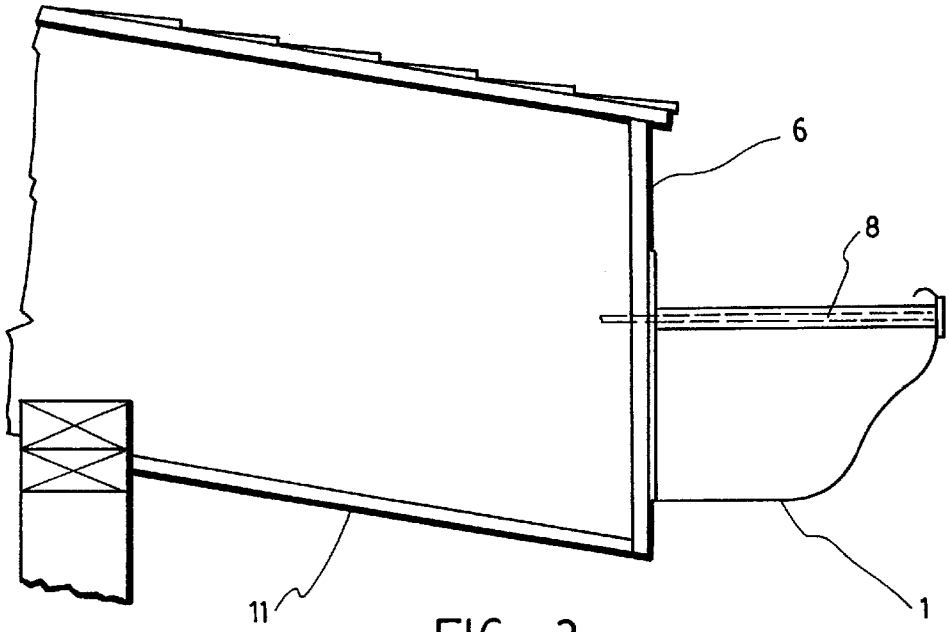
FIG. 3 ( PRIOR ART )
FIG. 3, labelled "Prior Art" represents existing gutter installation.

FIG. 2 shows the same gutter 1 pivoted, or swung-out to the inoperative position, under the cornice for maintenance or winter month storage.

Figure 5A:
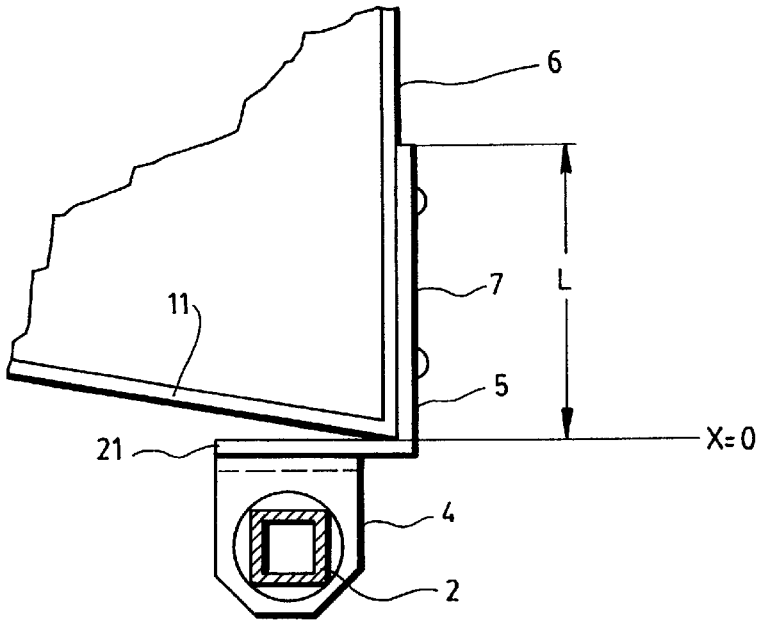
FIG. 5A represents a cross-section of shaft bearing and hanger at start position of gutter pitch.

FIG. 5A is a sectional view of the bearings 4 attached to the horizontal leg 21 of the hangers 7, which as mentioned above, is attached to fascia 6 by its vertical leg 5. This vertical leg 5 of the hanger locates the horizontal leg 21 and the bearing at the operational level at the bottom of the fascia 6.

Figure 9A:
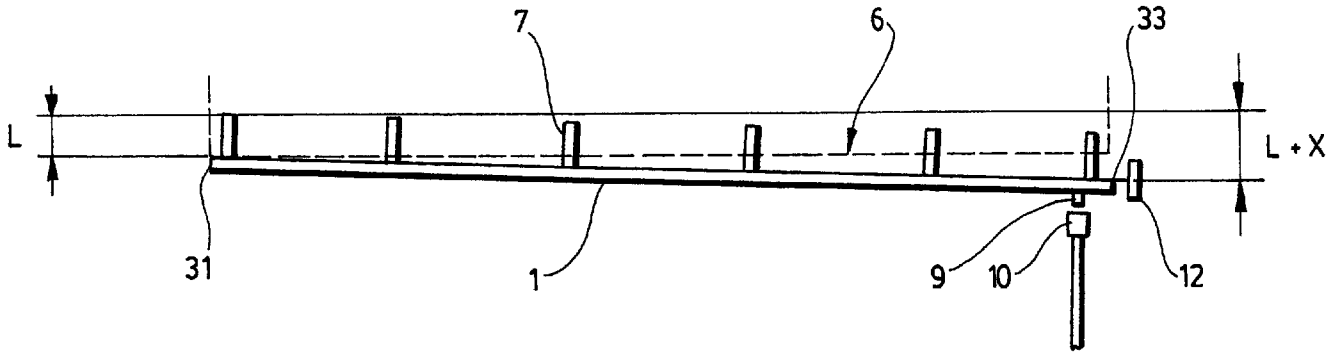
FIGS. 9A, 9B and 9C show various pitches of the gutter for short or long run of the roof.
Figure 9B:
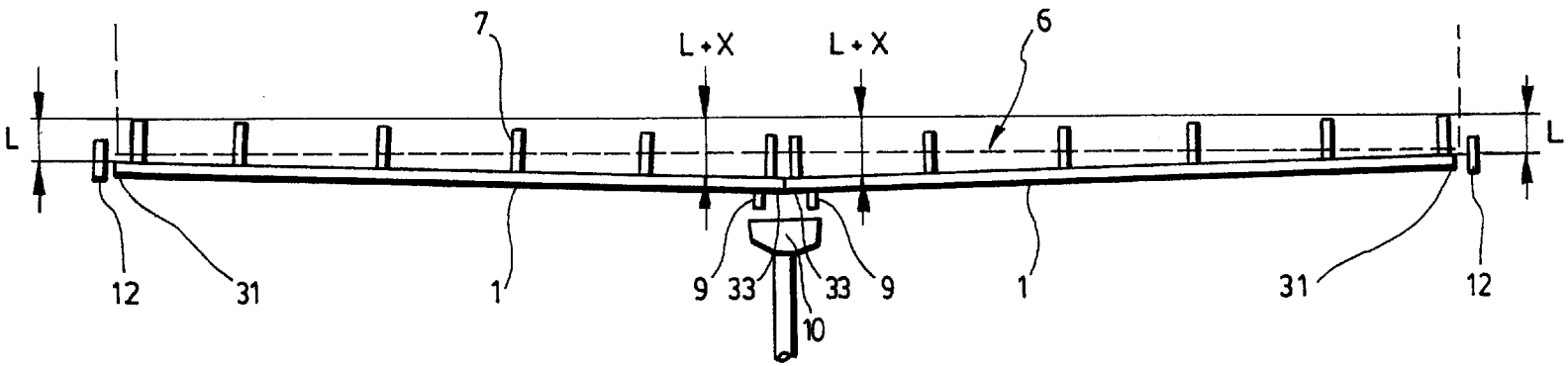
Figure 9C:
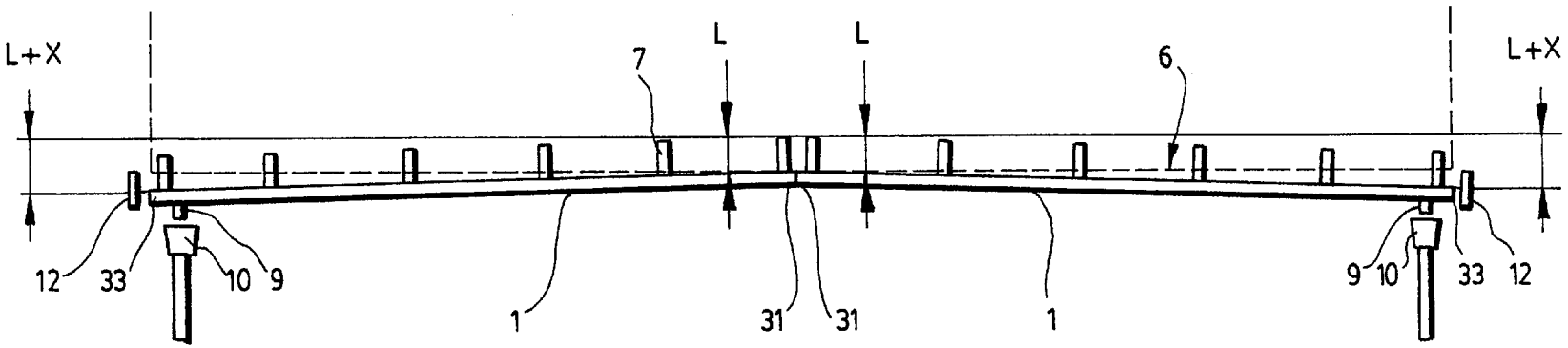

In a preferred embodiment of the invention, the hangers are all of the same length and installed at varying positions from L to L+X. This is to insure a predetermined pitch for the shaft, and accordingly the gutter. In such a case, the down-spout of the gutter is located adjacent the hanger at the lowest position L+X. As shown in FIG. 9A, 9B, and 9C, the hanger 7 is located at position L at one end 31 of the gutter. The hanger 7 is located at a position L+X adjacent the other end 33 of the gutter, this end 33 being the end provided with the down-spout 9. FIG. 9A shows the basic implementation of the system according to the invention. It comprises one length of gutter and a plurality of hangers having all the same length and located vertically at positions between L and L+X. The end 33 of the gutter is provided with a down-spout 9, located above a downward fixed collector 10. The gradual lowering of the hangers 7 from one end 31 of the gutter to the other end 33 of the gutter insures a downward pitch, as clearly seen in FIG. 9A, which aids in the evacuation of the water towards the down-spout 9, and eventually into the downward collector 10.

FIG. 9B shows a variation of the system of the invention, where in fact the gutter system is comprised of two assemblies, being mirror images of each other about the center of the roof. In this case, the down-spouts 9, and accordingly the hangers located at position L+X, are located adjacent the center, and the other ends 31 are located at opposite ends of the roof.

FIG. 9C shows another variation of the system according to the invention, where the gutter system is also comprised of two assemblies being mirror images of each other about the center of the roof, but where the down-spouts and accordingly the hangers at a position L+X, are located at the opposite ends of the roof.

Figure 5B:
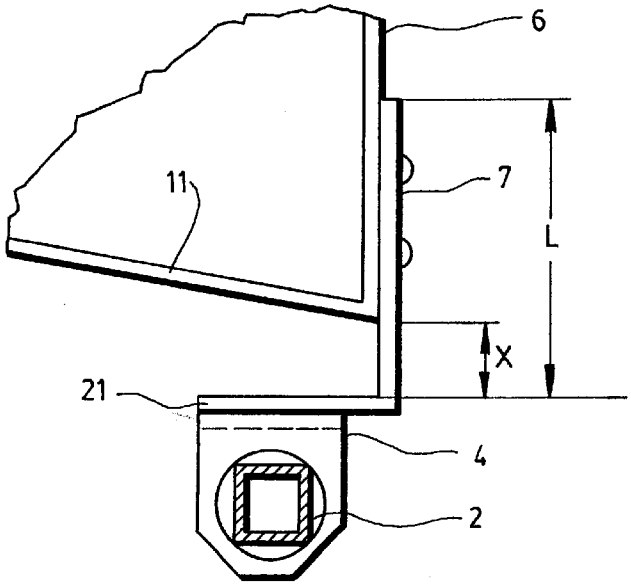
FIG. 5B represents hanger and bearing at the lower position for the discharge.

Referring now to FIGS. 5A and 5B, the hanger 7 (FIG. 5A), has its horizontal leg 21 adjacent the bottom of the fascia 6. However, the hanger at the position L+X has its horizontal leg 21 spaced from the bottom of the fascia 6 by the distance X. By aligning the vertical legs 5 of the hangers at the downward pitch, the shaft and the gutter are automatically oriented at the correct pitch. In order to ease installation of the system of the invention, all hangers have the same vertical length. To insure gutter's pitch toward the down-spout, the hanger horizontal leg 21 is lower than the fascia bottom distance X lowering automatically the bearing shaft and gutter assuring proper pitch of the gutter toward the drop outlet at the end of the gutter. All hangers follow the pitch line.

Since the gutter assembly is pivoted downwardly, there must be sufficient clearance for the down-spout to pivot free of the downward collector 10. FIG. 6A and FIG. 6B are front and side elevation showing the gutter's down-spout 9. Usually, it is a standard drop outlet completing the gutter's lower end with its cup end outlet.

According to a preferred embodiment of the invention, the down-spout 9 is located above another standard gutter downward collector 10 which is fixed and attached to the house wall, forming a collector for rainwater from down-spout 9. This collector is oriented perpendicularly to the gutter 1 so that the rotating gutter's movement swings the down-spout 9 away from the collector 10, toward the wall of the house and under the cornice 11. The collector 10 can be covered by a plastic bag for the winter months thus being protected from collecting debris, ice and snow. If the gutter system according to the invention is not so configured, it will be necessary for the homeowner to detach the down-spout 9 from the collector 10 before pivoting the gutter assembly.

As mentioned previously, the gutter system according to the invention is also provided with means for pivoting the gutter. Preferably, these means include a wormgear drive including a hand operated crank to drive the worm. The wormgear 12 can be located at any end of the shaft at high or low pitch, but at the outside of the house fascia 6. The wormgear is connected to a portion of the square shaft by a special square coupling which at one end is connected to the interior of the square shaft, and at the other end accepts the wormgear flange with its set screws.

The worm 13 with its bearings is attached to a base plate 20 which is attached fixedly to house side fascia. The wormgear drive preferably is enclosed in a housing to protect it against weather attacks.

The worm's drive shaft 14 extends a few centimeters downwardly of the base 20 and is equipped with an eyelet 15.

A rod 16 with its crank extends the connection of the worm shaft 14 toward the ground level, permitting the operation of the worm gear's drive and the pivoting of the gutter, from ground level. The extension rod 16 can be disconnected from eyelet 15 and stored in a safe place when not in use.

Due to the operational nature of conventional non enveloping worm, the axial positioning of gear and worms is not critical. The driving member of the drive, the worm acts as a screw being turned so as to pull or push the wormgear 12 and the shaft 2 is automatically located in any position the worm stops rotating, usually for the summer or winter position, therefore not requiring any additional locking device to maintain the gutter in desired position, although a locking mechanism could be provided if necessary. It should also be obvious to a person skilled in the art that any other mechanical or motorized means to pivot the shaft will be encompassed in the present invention.

Figure 8A:
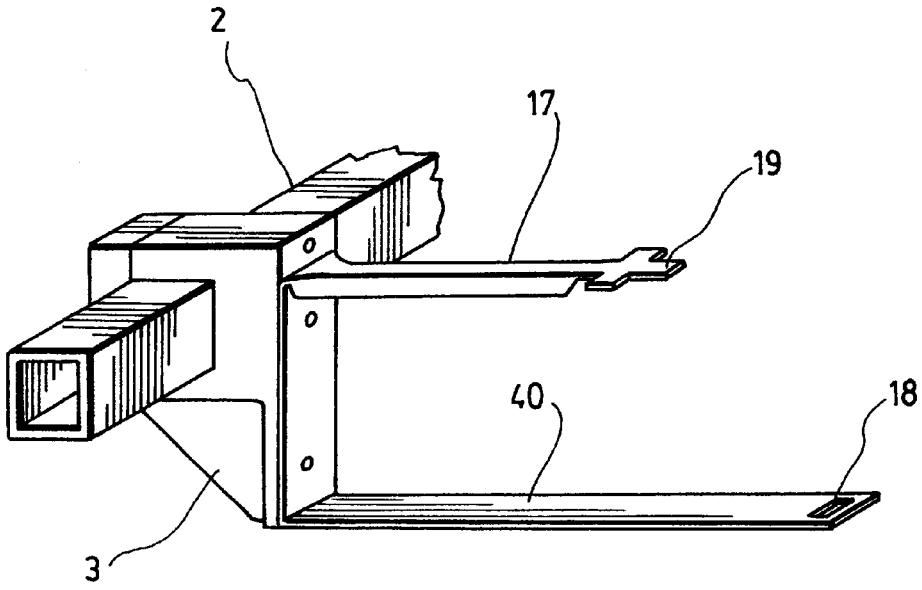
FIG. 8A represents the gutter band attached to bracket in open position.
Figure 8B:
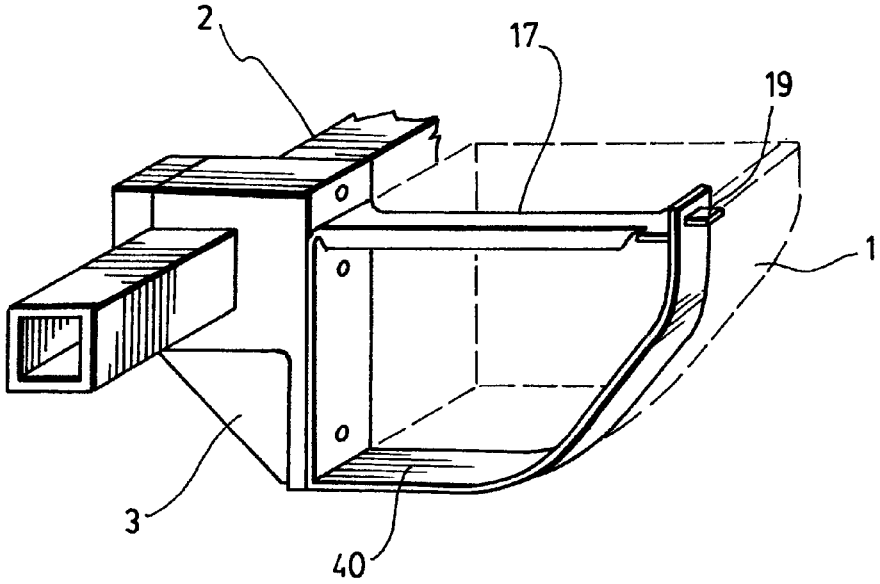
FIG. 8B represents the gutter holding band wrapped around the gutter in locked position attaching gutter to bracket and to shaft, without piercing of gutter's wall.

One of the subsidiary objects of the invention is to provide a means of attaching the gutter to the shaft without having to perforate a hole in the gutter. According to the invention, the shaft is provided with a plurality of brackets 3, and each bracket is provided with a top and bottom holding bands 17, 40. FIGS. 8A and B shows a gutter's top holding band part 17 in open position attached to the bracket 3. The top holding band part 17 section is straight and has a predetermined length to control the width of the gutter and to provide rigidity to the band over the gutter's open upper section. The bottom holding section 40 is a semi-rigid band provided with a slot 18 at its end. The slot 18 cooperates with a tongue 19 on the top holding band 17 when the gutter is placed within the bracket (shown in dotted lines in FIG. 8B). The bottom holding band 40 is wrapped around the gutter at its outside as shown in FIG. 8B. The tongue 19 is inserted into the slot 18 and bent toward the gutter and bracket, locking the band firmly in position against the bracket, and thereby securing the gutter within the band.

This folding band allows the lateral sliding movement of the gutter before it is locked in position by the wrapping and bending of the tongue 19, and the gutter is secured to the shaft and bracket without being perforated.

The band 17 is attached to the bracket 3 before it is attached to the shaft, the open end of the band permitting easy assembly of the gutter along the shaft, and subsequent locking in position.

The gutter's installation elements disclosed in the invention have two basic functions. Firstly, to install and orient the gutters for the efficient drainage of the rainwater. Secondly, by swinging-out to the vertical position, the gutters can be inspected, cleaned and put in the shelter of the cornice for winter months, being protected from snow and ice accumulation.

The standardized components disclosed by the invention and proposed to be supplied as a kit containing all necessary components for the gutter installation, can be adapted to almost any type of roof construction without any changes or addition to the roof and cornice. More specifically, a kit includes a plurality of hangers having standard lengths so that the pitch of the gutter can easily be followed. The kit also includes a gutter having a maximal length of 40 ft (or approximately 13 m).

The proposed parts kit permits simple and inexpensive installation of the gutters by homeowners or any handyman, offering a protection to gutters and house roof.

Although the present invention has been explained hereinabove by way of a preferred embodiment thereof, it should be pointed out that any modifications to this preferred embodiment within the scope of the appended claims is not deemed to alter of change the nature and scope of the present invention.

What is claimed is:

1. A pivotable gutter system for a roof, the roof having a cornice provided with a fascia, the system comprising:

a plurality of hangers mountable on the fascia in a manner spaced from each other by a predetermined distance and spanning a length of said fascia, each of said hangers having a top vertical leg for fastening to the fascia and a bottom horizontal leg for extending under the cornice, the bottom horizontal leg being provided with a bearing having a rotational axis;

a shaft having a rotational axis, said shaft being rotatably mountable in all of the bearings, with its rotational axis coincident with the rotational axis of the bearings;

a gutter having two opposite ends mountable with mounting means along the shaft, the gutter being provided with a downspout at one of its opposite ends; and means to pivot the shaft between an operative position and an inoperative position.

2. The pivotable gutter system according to claim 1, wherein said mounting means includes a plurality of bracket slidably mounted about the shaft, the brackets including a top holding band and a bottom holding band, the bottom holding band including a slot for mating with a tongue on the top holding band.

3. The pivotable gutter system according to claim 1, wherein said shaft has a square cross-section.

4. The pivotable gutter system according to claim 1, wherein the means to pivot the shaft include:

a wormgear drive including a toothed wheel mounted on the shaft, the wheel having a center of rotation coincident with the axis of rotation of the shaft and an endless screw adapted to engage the teeth of the wheel, the endless screw being further provided with an elongated shaft projecting downwardly.

5. The pivotable gutter system according to claim 4, wherein the shaft further includes an eyelet at its lowest extremity for receiving an extension rod.

6. A pivotable gutter system in combination with a roof, the roof having a cornice provided with a fascia, the system comprising:

a plurality of hangers mounted on the fascia in a manner spaced from each other by a predetermined distance and spanning a length of said fascia, each of said hangers having a top vertical leg fastened to the fascia and a bottom horizontal leg extending under the cornice, the bottom horizontal leg being provided with a bearing having a rotational axis;

a shaft having a rotational axis, said shaft being rotatably mounted in all of the bearings with its rotational axis coincident with the rotational axis of the bearings;

a gutter having two opposite ends mounted with mounting means along the shaft, the gutter being provided with a downspout at one of its opposite ends; and means to pivot the shaft between an operative position and an inoperative position.

7. The pivotable gutter system combination according TO claim 6, wherein the hangers are vertically located at a position ranging from L to L+X, so that the gutter downspout is located adjacent to the hanger at the position L+X and the other opposite end of the gutter is located adjacent to the hanger at the position L, so as to provide a downward pitch for the gutter from the other opposite end of the gutter towards the downspout.

* * * * *